US005406821A

United States Patent [19]

Sabine et al.

[11] Patent Number: 5,406,821

[45] Date of Patent: Apr. 18, 1995

[54] TUBE BENDING APPARATUS AND METHOD

[75] Inventors: James R. Sabine, Burlington; Douglas T. DeVouge; Michael W. Van Heurn, both of Brantford, all of Canada

[73] Assignee: Eagle Precision Technologies, Inc., Brantford, Canada

[21] Appl. No.: 224,581

[22] Filed: Apr. 7, 1994

[51] Int. Cl.[6] ..... B21D 9/00; B21D 9/01; B21D 9/03

[52] U.S. Cl. ..... 72/150; 72/428; 72/369; 414/18

[58] Field of Search ..... 72/133, 150, 367, 419, 72/369, 428; 414/18; 294/115

[56] References Cited

U.S. PATENT DOCUMENTS

| | | | |
|---|---|---|---|
| 2,541,534 | 2/1951 | Muir | 72/347 |
| 3,473,361 | 10/1969 | Cwik | 72/150 |
| 4,481,803 | 11/1984 | Dieser | 72/150 |
| 5,195,343 | 3/1993 | Malarz | 72/133 |

*Primary Examiner*—Lowell A. Larson
*Assistant Examiner*—Rodney A. Butler
*Attorney, Agent, or Firm*—C. Brian Barlow

[57] ABSTRACT

A tube loading assembly for use in loading a tube on a flexible mandrel of a tube bending machine; said assembly comprising mandrel receiving means for receiving said mandrel; mandrel alignment means for aligning said received mandrel to be co-axial with said tube; and means for feeding said tube on said co-axially aligned mandrel. The assembly is of use with tubes to be bent for use in automotive exhaust systems, heat exchangers and aircraft hydraulic systems, and provides for improved automatic loading speeds.

5 Claims, 5 Drawing Sheets

TUBE BENDING APPARATUS AND METHOD

FIELD OF THE INVENTION

This invention relates to tube bending apparatus for bending rigid tubes, such as those used in automotive exhaust systems, having a flexible mandrel for receiving thereon the tube to be bent, and more particularly to the automatic loading of said tubes by an improved tube loading assembly.

BACKGROUND OF THE INVENTION

When tube is bent about a bending surface, problems frequently arise in kinking of the tube or at least in stretching of the tube so that the circumferential dimensions of both the inner and outer surfaces of the tube are not true in the region of the bend. Thus, for example, when round tube is bent, its cross-section may be appreciably off-round in the region of the bend. Thus, the cross-section may be a flattened oval. To alleviate such problems, tube is frequently bent over a flexible mandrel conforming to the internal shape of the tube. Thus, if round tube is to be bent, the internal mandrel will have a circular cross-section and if square tube is to be bent, then the internal mandrel will have a square cross-section. Various suitable flexible mandrels are known, for example, such as that described in U.S. Pat. No. No. 3,455,142 issued Jul. 15, 1969 to Roberts.

Although the use of flexible mandrels is generally satisfactory in maintaining the form of the tube during bending, the flexibility of the mandrel presents problems during loading of the mandrel into the mouth of the tube especially where the process is automated and loading is fast.

In rotary draw bending machines, for bending tubes or pipes, such as those used in automotive exhaust systems, heat exchangers and aircraft hydraulic systems, a straight tube is loaded into the machine and the machine performs several operations to form the tube around a radius block. The machine may automatically relocate the tube and perform more bending operations to form the completed part. It is often desirable to have the machine automatically loaded with the straight tube to minimize the manual effort required and to provide consistency in terms of the location of the weld seam on the tube.

Previous automatic loading devices have means for selecting straight tubes from a bin or rack and moving the tube into a position where it is aligned with the tube gripping device on the bending machine. The loading device then moves the tube onto the gripping mechanism such that the bending machine grips the tube. Alternatively, the loading device simply holds the tube in the aligned position and the bending machine moves its gripping mechanism forward to grip the tube. The means for loading the tubes into the machine is generally a simple pick and place mechanism which moves the tube from one known position (the output chute of a tube rack) to another known position (the loading point for the bending machine). An alternative means for loading the tube is a programmable robot device which is programmed to select tubes from a bin and load them into the machine.

While systems such as these have been successfully implemented on many bending machines, the task is made more difficult on machines which utilize a flexible internal mandrel to support the inner wall of the tube during bending operations. This is due to the fact that means to align the flexible portion of the mandrel with the tube is required before the tube can be loaded. Previous systems to overcome this problem have involved retracting the mandrel assembly inside of a stationary rigid sleeve to support the mandrel, loading the tube into a collet and then advancing the mandrel back into the tube for bending, as described in UK Patent No. 2043504 to H. Benteler et al. While this system has been successful, it requires a relatively complex modification to the bending machine and it is not feasible when an internal collet system is employed. It also involves a relatively large motion of the mandrel assembly and, thus, requires significant operation time.

SUMMARY OF THE INVENTION

It is an object of the present invention to provide a tube loading assembly having a mandrel alignment device which provides for enhanced automatic rates of tube loading.

It is a further object of the present invention to provide a tube loading assembly which does not require additional tube bending machine operating steps during tube loading.

It is a yet further object of the present invention to provide an improved and efficient process of loading a tube on a flexible mandrel for subsequent tube bending operations.

These and other objects of the invention will become apparent from a reading of this specification as a whole.

The present invention provides a tube loading mechanism which includes a mandrel orientation device to straighten the mandrel before loading the tube into the machine, i.e. to align the mandrel co-axially with the tube to allow loading of the tube on the mandrel. This system can be used with either internal or external collet systems and does not require any modifications to the actual bending machine. The invention does not require any additional machine motions when loading the tube and thereby allows for loading tubes over a mandrel as quickly as the tube loading mechanism can operate.

Accordingly, the present invention provides, in its broadest aspect, a tube loading assembly for use in loading a tube on a flexible mandrel of a tube bending machine; the assembly comprising mandrel receiving means for receiving the mandrel; mandrel alignment means for aligning the received mandrel to be co-axial with the tube; and means for feeding the tube on the co-axially aligned mandrel.

Thus, the mandrel alignment means operably causes the mandrel, after it has readily and easily entered the receiving means, to be subsequently, properly aligned co-axially with the tube to be embraced thereby when the tube is fed on the now aligned mandrel.

In a preferred aspect, the invention provides a tube loading assembly for use in loading a tube on a flexible mandrel of a tube bending machine comprising mandrel embracing jaw members; jaw actuating means cooperable with the jaw members to operably open the jaw members to receive the mandrel and to close the jaw members to effect axial alignment of the mandrel with the tube within the closed jaw members; and means for feeding the tube on the mandrel in the closed jaw members.

In a more preferred embodiment the jaw actuating means comprises a first bias means-loaded pivotable scissor assembly and also a second bias means-loaded pivotable scissor assembly cooperable with the jaw members to effect opening and closing thereof. One bias means is represented by a coil spring which is actuated by the tube feeding mechanism.

Preferably, the flexible mandrel is mounted on a collet assembly of a bending machine.

BRIEF DESCRIPTION OF THE DRAWINGS

In order that the invention may be better understood, a preferred embodiment will now be described, by way of example only, with reference to the accompanying drawings, wherein.

DESCRIPTION OF A PREFERRED EMBODIMENT

Figure 1:
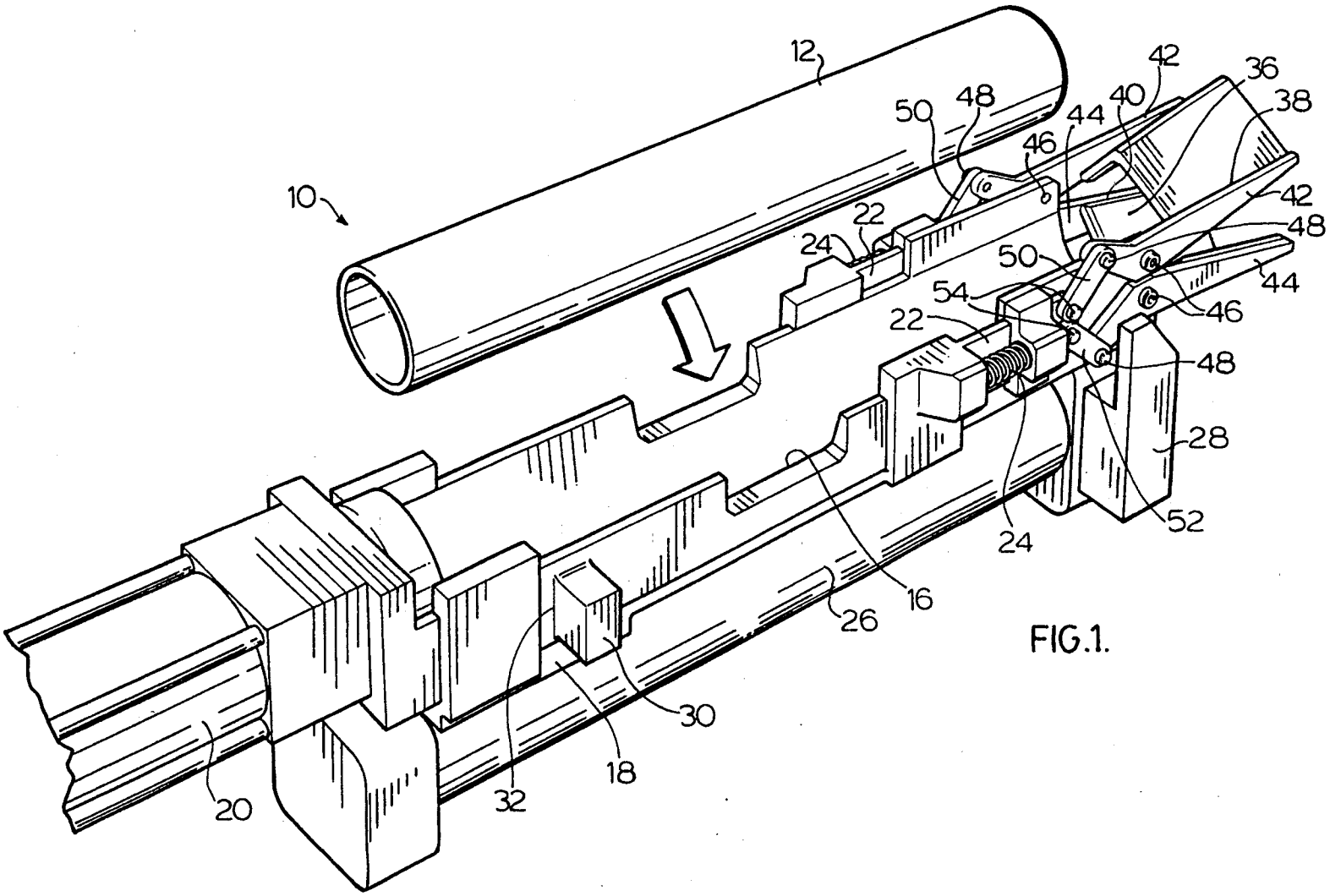
FIG. 1 is a perspective view of a tube loading assembly according to the invention.

The figures show generally as 10, a tube loading assembly ready to receive or already retaining a tube 12 for feeding onto a flexible mandrel 14 of a tube bending machine (not shown).

Assembly 10 is located so as to cooperate with the bending machine through flexible mandrel 14 as hereinafter described, while being so located as to not interfere with the subsequent tube bending and tube unloading steps of the tube bending machine. Assembly 10 may form part of a bending machine by being directly affixed thereto, or may be a stand-alone assembly supported by stands, supports and the like (not shown). Assembly 10 is, however, so disposed as to receive individual tubes from a rack, stack or other plurality of stored tubes (not shown) automatically, which rack, stack and the like does not interfere with the tube loading, bending and unloading operations of the bending machine. Such automatic feeding systems may use a pick and place mechanism or comprise robotic means. Alternatively, the tube feeding may be accomplished manually.

Assembly 10 has a tube nest 16, partially defined by a tube carrier slide 18, into which tube 12 is fed from a tube rack (not shown) and a cylinder 20. Slide 18 at its forward portion is formed with a pair of pushing bars 22 and associated coil springs 24. The entire assembly of tube nest 16, slide 18 and a cylinder 20 is mounted on a shuttle cylinder base 26 having a fixed mechanical stop 28, which limits the forward position of tube nest 16 during the tube loading on mandrel 14 operation, by interaction with a stop block 30 located at a rear portion 32 of slide 18. Slide 18 is moveable by means of shuttle cylinder 26, which propels nest 16 and its associate tube 12 in a horizontally, forward direction as shown by horizontal arrows (FIG. 2B).

Assembly 10 has a pair of V-shaped closeable, mandrel embracing, upper and lower jaws 34, 36, respectively, fixed at their edges 38, 40, respectively to a pair of parallel, spaced apart V-shaped upper and lower scissor members 42,44 respectively, one edge of 38 being fixed to one upper member 42, other edge of 38 to other upper member 42, one edge 40 to lower member 44 and other edge 40 to other lower member 44. Scissor members 42 and 44 abut, one to the other, at their respective apexes thereof and are each pivotly mounted by rotatable pin joints 46 to a forward portion of slider 18.

Each of scissor members 42 and 44 are pivotally connected at their rear ends by rotatable upper and lower pin joints 48 to upper and lower jaw closing levers 50, 52 respectively. Levers 50, 52 are pivotally mounted by rotatable pin joints 54 to pushing bars 22. The combination, comprising with members 42, 44 a pivotable scissor assembly, of each pushing bar 22, jaw closing levers 50, 52 and rotatable pin joints 46, 48, 54, creates a dual linkage mechanism, one each side of slider 18, which operably causes jaws 34, 36 to open and close. Jaws 34, 36 are held in a mandrel-receiving open position by springs 24, when the latter are in their extended or relaxed mode, which cause pushing bars 22 to reside in a return position relative to nest 16.

Figure 2A:
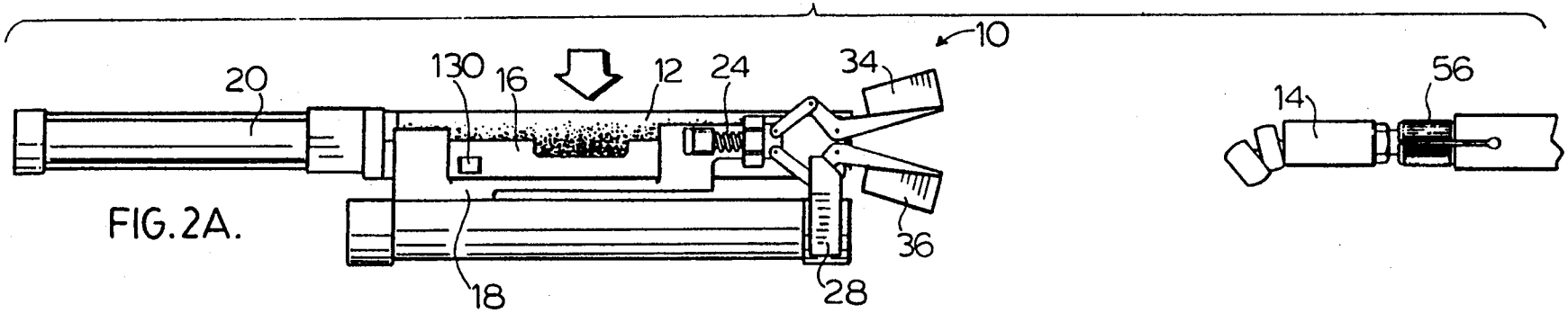
FIGS. 2A–2E show diagrammatic side views of an assembly according to the invention in association with a tube and an internal collet system having a flexible mandrel, in various tube loading positions.
Figure 2B:
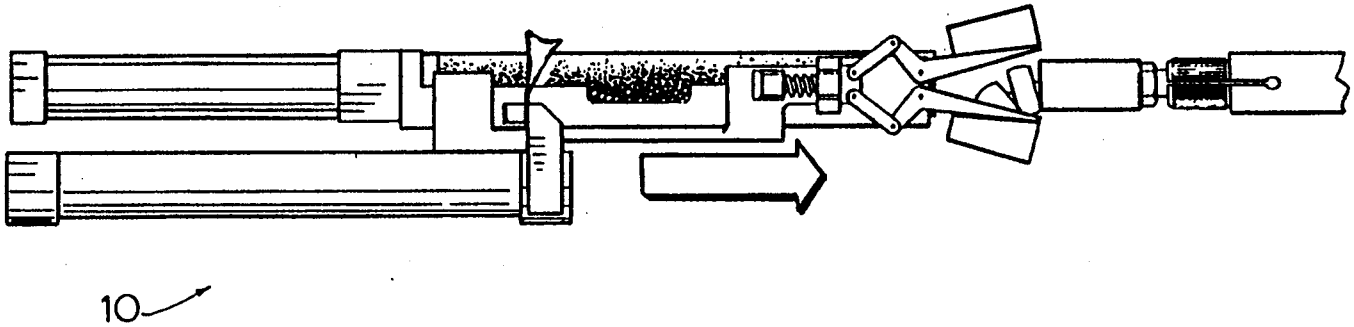
Figure 2C:
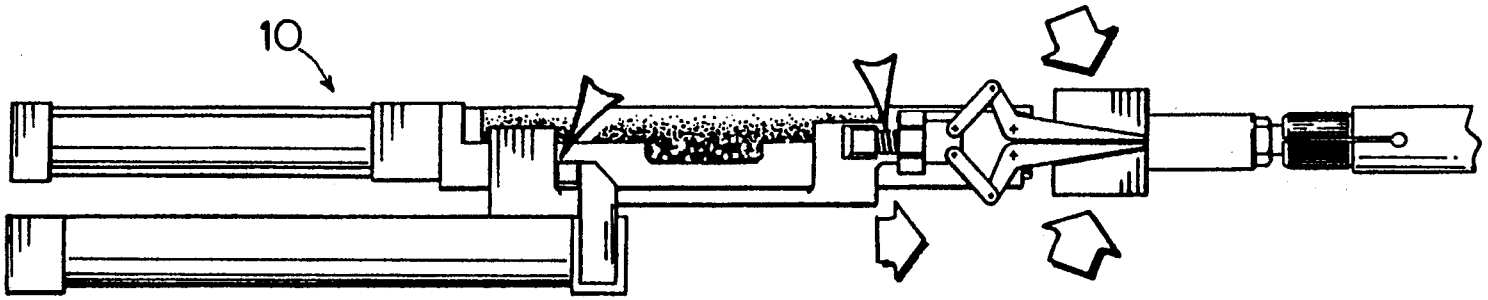

In operation, straight tube 12 is placed into tube nest 16 for loading into the bending machine, represented by a tube gripping collet 56 (FIGS. 2A–2C). Typical flexible mandrel 14, shown in front of tube collet 56, is inserted into tube 12 during the tube loading operation. The machine tube loading positions are illustrated in FIGS. 2B–2E.

With reference to FIGS. 2A–2E, these show particular stages of the tube loading operation.

FIG. 2B shows the loading stage after shuttle cylinder 26 has advanced tube nest 16 into a commencing loading area. At the stage shown, tube nest 16 has reached its forward limit, which is determined by mechanical stop 28 abutting stop block 30, as shown by dark arrow.

FIG. 2C shows shuttle cylinder 26 after it has continued its forward motion to the end of its stroke. The last small motion of cylinder 26 and slider 18 actuates jaw member closing by compressing springs 24, as shown by dark arrow, on the pivotable scissor assembly to effect closing around mandrel 14. This action has the affect of aligning the flexible portion of mandrel 14 with tube nest 16, and, thus, tube 12. Vertical open arrows indicate closing action of jaws.

Figure 2D:
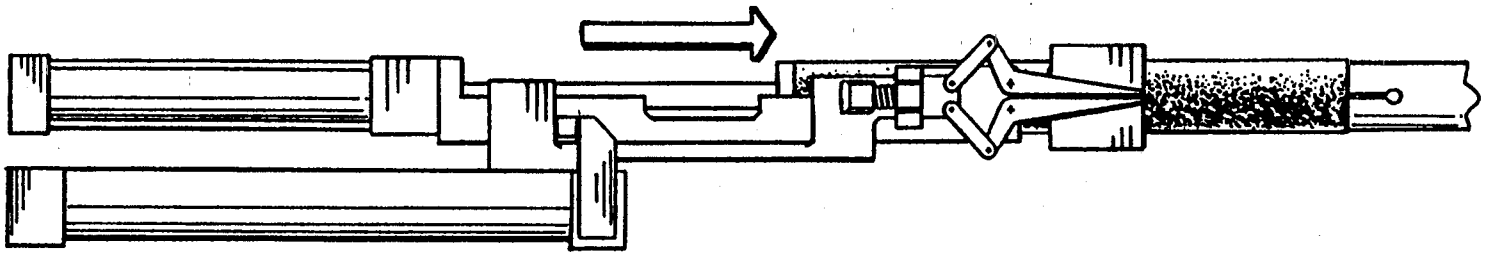

FIG. 2D stage shows tube pushing cylinder 20 has pushed tube 12 through jaws 34, 36, over mandrel 14 and on to collet 56. At this point, the bending machine is signalled to activate collet 56 to thereby grasp tube 12.

Figure 2E:
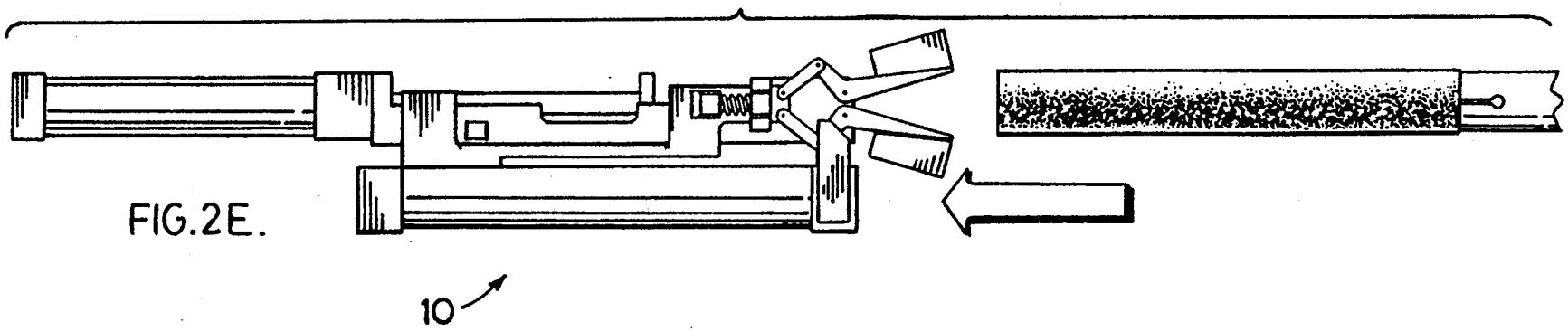

FIG. 2E stage shows both cylinders 20, 26 of the loading system have retracted from the bending machine to leave tube 12 on bending machine collet 56. Jaws 34, 36 have opened automatically as cylinders 20, 26 retract, allowing strings 24 to return to their relexed state.

This operation is more better described as follows:

When mandrel 14 of the bending machine is ready to receive a new tube 12, shuttle cylinder 26 moves carrier slide 18 forward (FIG. 2B). As carrier slide 18 moves, tube nest 16 also moves forward due to the connections between pushing bars 22, jaw closing levers 50, 52, closeable jaws 34, 36 and tube nest 16. Closeable jaws 34, 36 are maintained in the open state during this motion by mechanical springs 24, which prevents linkage pins 54, which are fixed to slider 18 from moving forward relative to linkage pins 46, which are fixed to tube nest 16.

When stop block 30, mounted on tube nest 16, reaches fixed mechanical stop 28 on shuttle cylinder 26, the motion of tube nest 16 stops, which also stops the forward motion of linkage pins 46. Shuttle cylinder 26 continues to move carrier slide 18 forward, thereby causing pushing bars 22 to move linkage pins 54 forward relative to linkage pins 46. This relative motion causes closing levers 50, 52 to rotate pin joints 46 and closeable jaws 34, 36, apart, which in turn causes closeable jaws 34, 36 to close (FIG. 2C). Fixed mechanical stop 28 on shuttle cylinder 26 and stop block 30 on tube nest 16 are so located such that the forward motion of tube nest 16 stops when closeable jaws 34, 36 are located around the flexible portion of mandrel 14. The closing motion of jaws 34, 36, thus aligns mandrel 14 with the longitudinal axis of tube 12 in preparation for loading.

Once closeable jaws 34, 36 have closed around mandrel 14, pushing cylinder 20 moves forward. Pushing cylinder 20 acts against the back end of tube 12 to move it through closeable jaws 34, 36 over aligned mandrel 14 and on to collet 56 of the bending machine (FIG. 2D). At this stage, the bending machine collet 56 can grip tube 12.

When tube 12 has been loaded, shuttle cylinder 26 and pushing cylinder 20 both retract to remove the loading assembly from around tube 12. Jaws 34, 36 automatically open as shuttle cylinder 26 retracts due to the action of springs 24.

The length and diameter of the tube nest may be varied to suit the tube being loaded in any given particular application. The tube pushing mechanism may be varied from that shown hereinabove in that it could be made to grip the outer wall of the tube rather than pushing on the end of the tube for those applications where the loading of long tube sections is required. This would prevent the necessity of providing a tube nest as long as the tube being loaded.

It will be readily appreciated that the tube may be loaded onto the bending machine with an external collet as an alternative to the internal collet as hereinabove shown.

Figure 3:
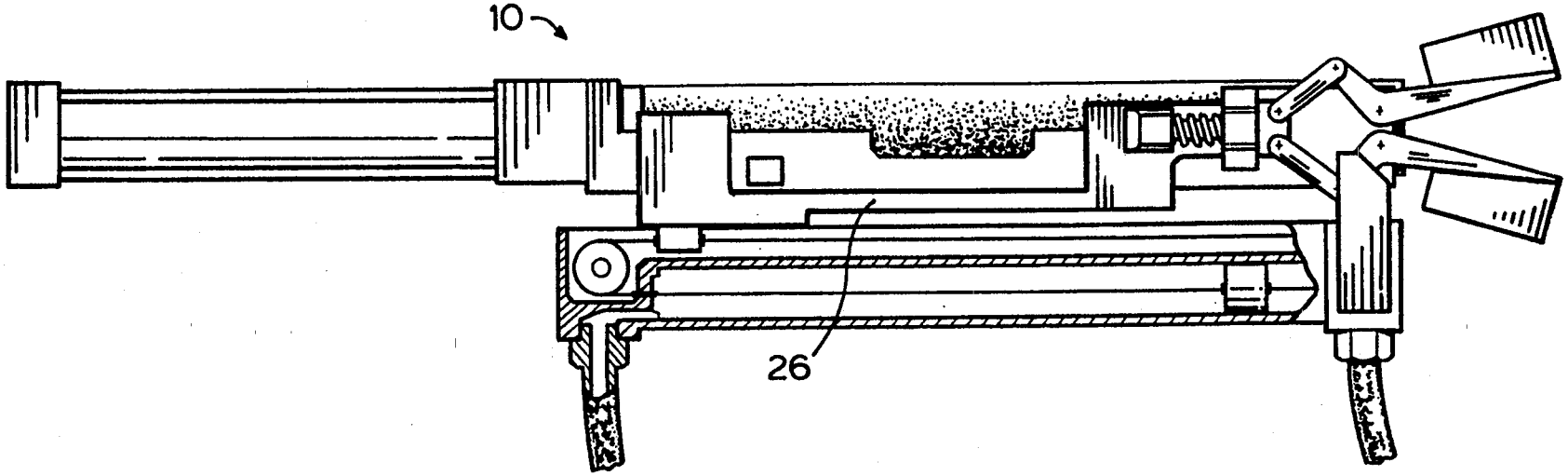
FIG. 3 represents a cross-sectional view of a tube loading assembly of the invention in association with a hydraulically operated shuttle cylinder.

FIG. 3 better illustrates assembly 10 and a typical hydraulic mechanism of shuttle cylinder system 26 indicating how the tube loading mechanism is operated.

The loading assembly of the present invention provides advantages over known methods and apparatus in that the invention apparatus does not require use of a rigid sleeve with its attendant disadvantages. It also does not require the bending machine to become longer to allow for the additional mandrel retraction motion. Further, this system does not require additional machine motions during loading and, thus, saves loading time. Yet further, the apparatus of the invention may be an external device to the bending machine and can thus be added as required. It does not require modifications to the actual bending machine and is, thus, of use with existing bending equipment.

Although this disclosure has described and illustrated a certain preferred embodiment of the invention, it is to be understood that the invention is not restricted to that particular embodiment. Rather, the invention includes all embodiments which are functional or mechanical equivalents of the specific embodiment and features that have been described, illustrated and claimed in the appended claims.

We claim:

1. A tube loading assembly for use in loading a tube on a flexible mandrel of a tube bending machine; said assembly comprising mandrel receiving means for receiving said mandrel; mandrel alignment means for aligning said received mandrel to be co-axial with said tube; and means for feeding said tube on said co-axially aligned mandrel.

2. A tube loading assembly for use in loading a tube on a flexible mandrel of a tube bending machine; said assembly comprising mandrel embracing jaw members; jaw actuating means cooperable with said jaw members to operably open said jaw members to receive said mandrel and to close said jaw members to effect axial alignment of said mandrel with said tube within said closed jaw members; and means for feeding said tube on said mandrel in said closed jaw members.

3. A tube loading assembly as claimed in claim 2 wherein said jaw actuating means comprises a first bias means-loaded pivotable scissor assembly and a second bias means-loaded pivotable scissor assembly cooperable with said jaw members to effect opening and closing of said jaw members.

4. A tube loading assembly as claimed in claim 3 wherein said bias means comprises coil spring means.

5. A tube loading assembly as claimed in claim 3 wherein said bias means are operably actuated by said tube feeding means.

* * * * *